US006215972B1

(12) United States Patent
An et al.

(10) Patent No.: US 6,215,972 B1
(45) Date of Patent: Apr. 10, 2001

(54) APPARATUS FOR CLEANING A SQUEEZE ROLLER OF A LIQUID PRINTER

(75) Inventors: Hyung-jin An, Suwon; Kyeong-hwan Kim, Yongin, both of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/339,677

(22) Filed: Jun. 24, 1999

(30) Foreign Application Priority Data

Jun. 26, 1998 (KR) ..... 98-24407

(51) Int. Cl.[7] ..... G03G 15/10; G03G 21/00
(52) U.S. Cl. ..... 399/249; 399/350
(58) Field of Search ..... 399/249, 350, 399/351; 15/256.51

(56) References Cited

U.S. PATENT DOCUMENTS

Re. 30,924 * 5/1982 Katayama et al. ..... 15/256.51
4,568,175 * 2/1986 Inowa et al. ..... 399/351
5,043,769 * 8/1991 Osawa et al. ..... 399/351
5,153,659 * 10/1992 Maiefski et al. ..... 399/249 X
5,321,483 * 6/1994 Yokoyama et al. ..... 399/350
5,363,182 * 11/1994 Kuribayashi et al. ..... 399/350
5,937,250 * 8/1999 Kwak et al. ..... 399/249
5,987,297 * 11/1999 Kimoto et al. ..... 399/350

* cited by examiner

*Primary Examiner*—Fred L. Braun
(74) *Attorney, Agent, or Firm*—Sughrue, Mion, Zinn, Macpeak & Seas, PLLC

(57) ABSTRACT

An apparatus for cleaning a squeeze roller of a liquid printer. The apparatus has general application for removing developer formed of a toner and a liquid carrier which adheres to an outer circumferential surface of the squeeze roller during lamination of the developer. The apparatus includes a blade holder and a blade having a plate of a predetermined rigidity. A cover member is coated on or adhering to the plate and has a lesser rigidity than the plate. One end of the blade is fixedly coupled to the blade holder and an opposite end thereof contacts the outer circumferential surface of the squeeze roller. The blade is disposed to be slanted in a trail counter direction to the rotational direction of the squeeze roller in a drip-line removing mode. Thus, the developer adhering to the squeeze roller can be cleaned.

3 Claims, 5 Drawing Sheets

APPARATUS FOR CLEANING A SQUEEZE ROLLER OF A LIQUID PRINTER

BACKGROUND OF THE INVENTION

1. Field of the Invention

The present invention relates to an apparatus for cleaning a squeeze roller of a liquid printer, and more particularly, to an apparatus for cleaning a squeeze roller of a liquid printer in which the structure of a blade is improved to improve the efficiency in cleaning and extend the life span of the blade.

2. Description of the Related Art

A liquid electrophotographic printer prints an image by forming an electrostatic latent image by scanning a laser beam on a photosensitive medium, developing the image with a developer including toner of a predetermined color using a developing unit and transferring the developed image to a print medium.

The liquid electrophotographic printer, as shown in FIG. 1, includes a laser scanning unit (LSU) for forming an electrostatic latent image on a photosensitive medium 10 and a developing unit 20 for forming an image corresponding to the electrostatic latent image.

The developing unit 20 includes a developing vessel 21 and a developing roller 23 which is disposed to face the photosensitive medium 10 such that a predetermined gap G exists therebetween. The apparatus further includes a cleaning roller 25 for removing developer adhering to the outer circumferential surface of the developing roller 23 and an injector 27 for injecting developer containing toner and a carrier into the gap G is a squeeze roller 29 for separating the toner and the carrier by closely pressing the photosensitive medium 10, and a squeeze roller cleaning apparatus 30 for cleaning off the developer adhering to the squeeze roller 29 when a drip-line is removed.

The conventional squeeze roller cleaning apparatus 30, as shown in FIG. 2, includes a blade 31 contacting the outer circumferential surface of the squeeze roller 29 slanted at a predetermined angle. The apparatus further includes, a blade holder 33 fixedly holding the blade 31, and a spanking mechanism 35 for removing a holding volume Vh of the developer remaining between the blade 31 and the squeeze roller 29 by allowing the blade holder 33 to repeatedly pivot a plurality of times. As shown in FIG. 3, the blade 31 is formed of a single rubber member. To prevent a phenomenon in which a surface of a leading edge 31*a* of the blade 31 contacts the squeeze roller 29 since the blade 31 bends excessively by the rotation of the squeeze roller 29 (hereinafter, referred to as the overturn of the blade), the blade 31 is disposed in a trailing direction with respect to the rotational direction of the squeeze roller 29 in a drip-line removing mode.

To embody the above squeeze roller cleaning apparatus, in the developing unit 20, the pressing force and rotational direction of the squeeze roller 29 varies according to each of a home position, a development mode, and a drip-line removing mode. In the development mode, the pressing force between the squeeze roller 29 and a squeeze backup roller 29' is greatest and the squeeze roller 29 rotates in the direction the photosensitive medium 10 rotates by being passively rotated by the photosensitive medium 10. The squeeze roller 29 squeezes and separates most of the carrier from the developer adhering to the photosensitive medium 10 so as to form a film of the developer. In this mode, the blade 31 is disposed to be separated from the squeeze roller 29.

In the drip-line removing mode, a relatively weak force is applied between the squeeze roller 29 and the squeeze backup roller 29' compared to the development mode and the squeeze roller 29 rotates in a direction opposite to that which the photosensitive medium 10 proceeds. The blade 31 contacts the squeeze roller 29 and cleans the carrier adhering to the squeeze roller 29.

The squeeze roller cleaning apparatus for the conventional liquid printer having the above structure has the following disadvantages.

First, since a rubber member vulnerable to abrasion is adopted, the blade requires replacement after printing about 10,000 sheets of paper.

Second, since the blade is disposed in the trailing direction to prevent the overturn of the blade, the holding volume is generated due to the developer remaining between the blade and the squeeze roller so that the efficiency in cleaning is lowered.

Third, since a spanking mechanism for removing the holding volume is needed, the number of parts and the number of assembly steps increases.

SUMMARY OF THE INVENTION

To solve the above problems, it is an objective of the present invention to provide an apparatus for cleaning a squeeze roller of a liquid printer. The apparatus includes a blade having a structure which prevents overturn of a contact portion thereof when a squeeze roller rotates so that, by controlling the arrangement of the blade, the life span of the blade can be prolonged, formation of a holding volume can be prevented, and a spanking mechanism is not needed.

Accordingly, to achieve the above objective, there is provided an apparatus for cleaning a squeeze roller of a liquid printer by which developer adhering to an outer circumferential surface of the squeeze roller. The squeeze roller is used for forming a film of the developer formed of toner and liquid carrier by pressing the developer onto a photosensitive medium. The apparatus is comprised of a blade holder and a blade. The blade comprises a plate having predetermined rigidity and a cover member having a weaker rigidity than the plate and is coated on or adhering to an outer surface of the plate. One end of the blade being fixedly coupled to the blade holder and an opposite end thereof contacting the outer circumferential surface of the squeeze roller, wherein the blade is disposed to be slanted in a trail counter direction with respect to a rotational direction of the squeeze roller in a drip-line removing mode so that the developer adhering to the squeeze roller can be removed.

BRIEF DESCRIPTION OF THE DRAWINGS

Other features and advantages of the present invention will become more apparent by describing in detail a preferred embodiment thereof with reference to the attached drawings in which.

DETAILED DESCRIPTION OF THE INVENTION

Figure 1:
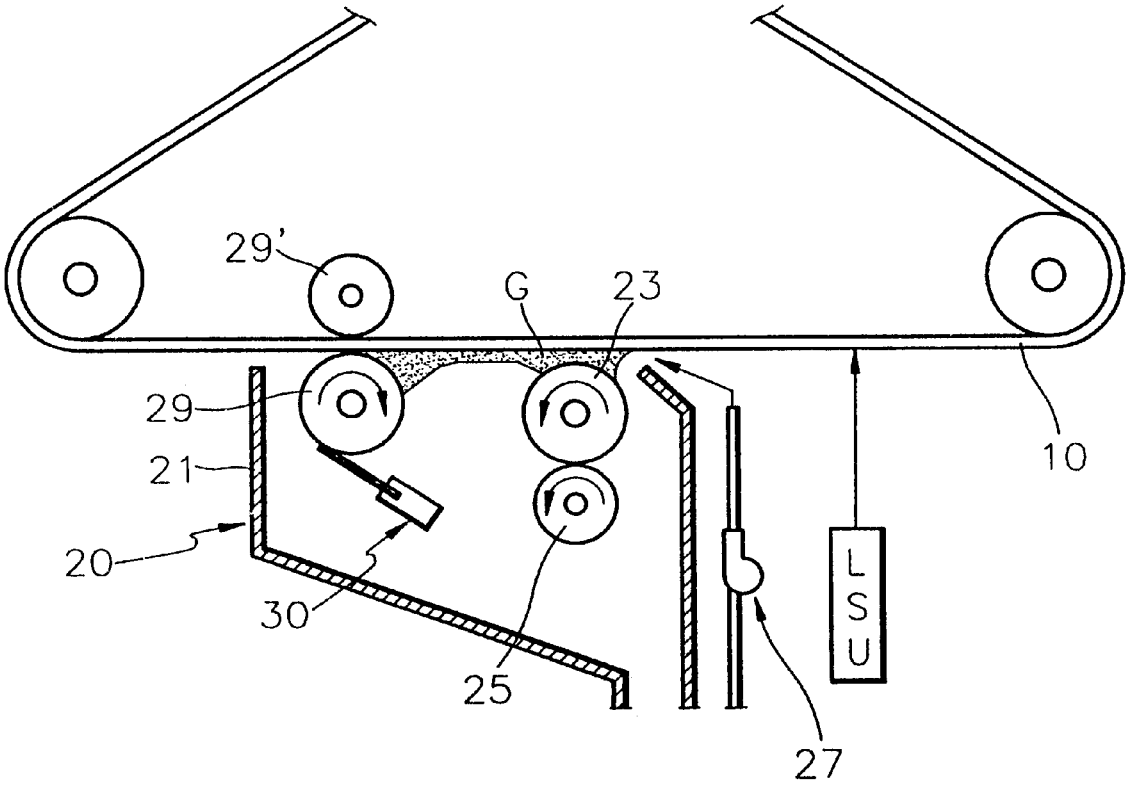
FIG. 1 (PRIOR ART)
FIG. 1 is a view showing a portion of a general liquid printer.
Figure 3:
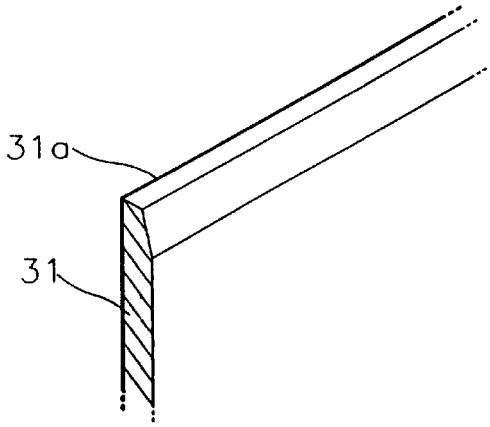
FIG. 3 (PRIOR ART)
FIG. 3 is a perspective view showing a portion of a blade of the apparatus for cleaning a squeeze roller for a conventional liquid printer.
Figure 4:
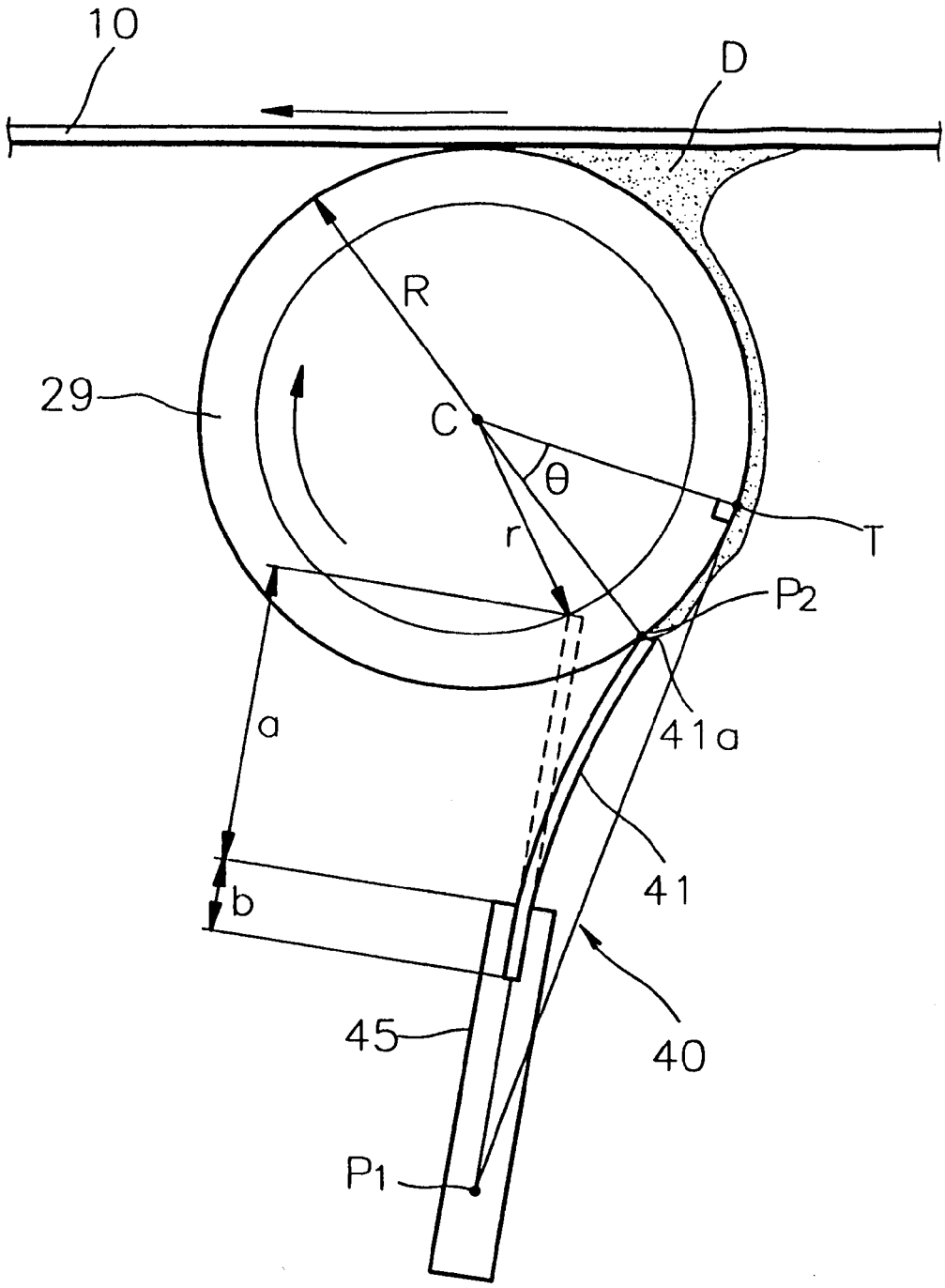
FIG. 4 is a side view showing an apparatus for cleaning a squeeze roller for a liquid printer according to a preferred embodiment of the present invention.

FIG. 4 shows an apparatus for cleaning a squeeze roller of a liquid printer according to a preferred embodiment of the present invention. Here, the elements having the same reference numerals as those shown in FIGS. 1 through 3 have the same functions. Referring to FIG. 4, an apparatus for cleaning a squeeze roller 40 of a liquid printer according to a preferred embodiment includes a blade holder 45 and a blade 41 fixedly coupled to the blade holder 45. The apparatus for cleaning a squeeze roller 40 cleans developer D adhering to an outer circumferential surface of the squeeze roller 29 for forming a film of the developer formed of toner and a liquid carrier by pressing the developer onto a photosensitive medium 10.

Figure 5:
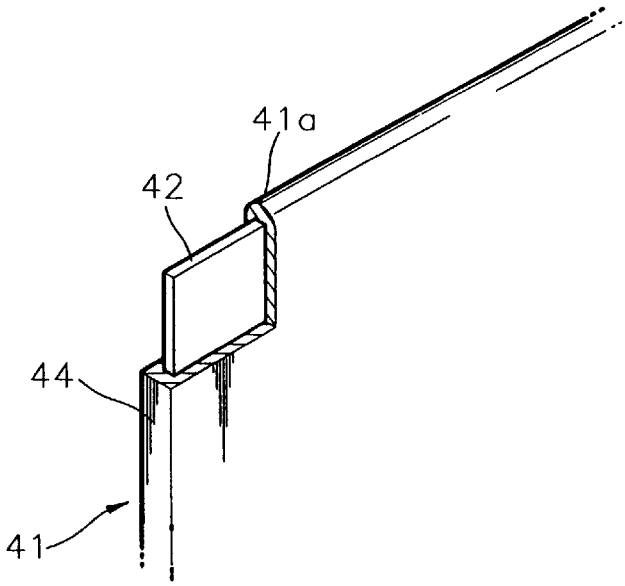
FIG. 5 is a partially cut-away perspective view showing a portion of the blade of the apparatus for cleaning a squeeze roller of a liquid printer according to the present invention.

One end of the blade 41 is fixed to the blade holder 45 and the other end thereof contacts the outer surface of the squeeze roller 29. The blade 41, as shown in FIG. 5, includes a plate 42 exhibiting a predetermined rigidity and a cover member 44 formed surrounding the plate 42.

The plate 42 is formed of an SUS-based material, for example, SUS304, whose rigidity is greater than that of the cover member 44 and elastically biases a leading edge 41*a* contacting the outer circumference of the squeeze roller 29. The cover member 44 is formed on the outer circumference of the plate 42 by being coated thereon or adhering thereto and is formed of a material exhibiting a weaker rigidity than the plate 42, for example, TEFLON. TEFLON (polytetrafluoroethylene) is synthetic resin resistant to heat and friction so noise generated due to the friction is reduced and overturn of the blade 41 is limited. Also, contamination due to fixation of developer D cleaned from the squeeze roller 29 is prevented.

The blade 41 having the above structure is disposed to be slanted in a direction of trail counter to the rotational direction of the squeeze roller 29. That is, when the squeeze roller 29 is driven in reverse to remove a drip-line, the inclination of the leading edge 41*a* of the blade 41 is disposed in a direction reverse to the rotational direction of the squeeze roller 29 and removes developer D adhering to the outer circumferential surface of the squeeze roller 29. In the present invention overturn of the blade 41 does not occur due to the rigidity of the plate 42 and the material properties of the cover member 44. Thus, holding volume Vh of the developer is not generated thus a spanking mechanism to allow the blade holder 45 to reciprocate and pivot is not needed.

In the apparatus for cleaning a squeeze roller 40 having the above structure, in order to increase pressure applied to the outer circumferential surface of the squeeze roller 29 due to the elastic bias of the blade 41, the blade 41 is preferably disposed to be bent while contacting the squeeze roller 29. The degree to which the blade is bent can be expressed as the amount of blade interference (R−r). Here, R denotes the radius of the squeeze roller 29 and r denotes the distance between the center of the squeeze roller 29 and the leading edge 41*a* of the blade 41 when the elastic bias applied to the blade 41 has been removed as indicated by a dotted line shown in FIG. 4.

Figure 6:
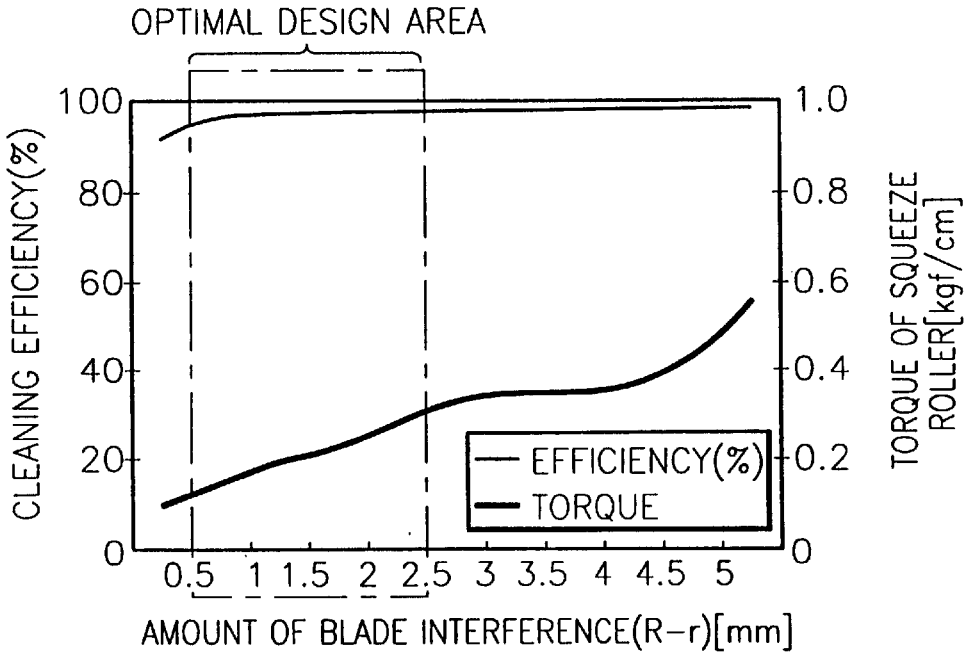
FIG. 6 is a graph indicating the efficiency and the torque of the squeeze roller according to changes in the amount of interference of the blade.

FIG. 6 is a graph indicating the efficiency and the torque of the squeeze roller according to changes in the amount of interference of the blade. It is preferable that the amount of blade interference satisfies the below Equation 1 considering the cleaning efficiency and the torque of the squeeze roller.

$$0.5\ \text{mm} < R - r < 2.5\ \text{mm} \qquad \text{[Equation 1]}$$

Figure 7:
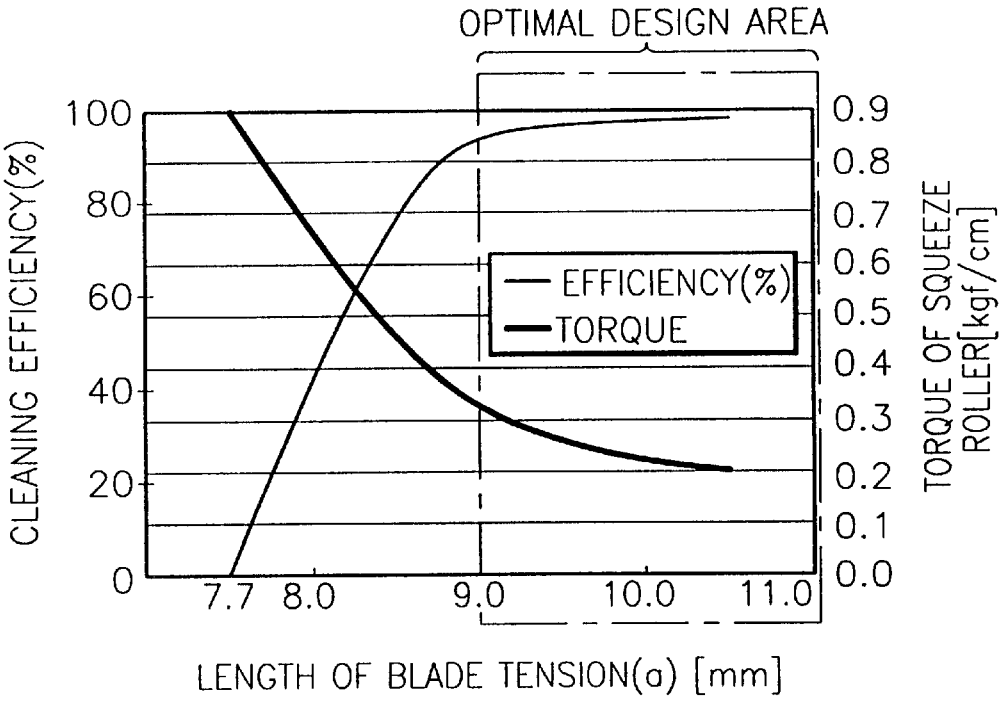
FIG. 7 is a graph showing the efficiency and torque of the squeeze roller according to changes in the length of a blade tension when the blade interference is 1.0 mm.

FIG. 7 is a graph indicating the efficiency in cleaning and the torque of the squeeze roller according to changes in the length of a blade tension when the amount of blade interference is 1.0 mm.

The length from the leading edge of the blade holder 45 to the leading edge of the blade 41 is defined as a and the length of the blade 41 fixedly inserted in the blade holder 45 is defined as b.

Considering the efficiency in cleaning and the torque of the squeeze roller 29 it is preferable that the tension length a satisfies Equation 2.

$$8\ \text{mm} < a < 15\ \text{mm} \qquad \text{[Equation 2]}$$

Preferably, the fixed length of the blade b satisfies Equation 3 to fixedly couple the blade 41 to the blade holder 45.

$$2.0\ \text{mm} < b \qquad \text{[Equation 3]}$$

Preferably, to define the tangential position of the leading edge of the blade 41, a blade pressure angle θ between line segments $\overline{CP_2}$ and $\overline{CT}$ satisfies the below equation 4.

$$5^\circ < \theta < 30^\circ \qquad \text{[Equation 4]}$$

Here, C is the center of the squeeze roller 29; P1 is a point where a definite straight line concurrently passing C and perpendicular to the proceeding direction of the photosensitive medium 10 meets with the center in a widthwise direction of the blade holder 45, P2 is a point of contact between the leading edge 41*a* of the blade 41 and the outer circumferential surface of the squeeze roller 29; T is a tangent point closer to P2 among two tangent points made by the line segments passing through P1 and contacting the outer circumference of the squeeze roller 29.

Figure 2:
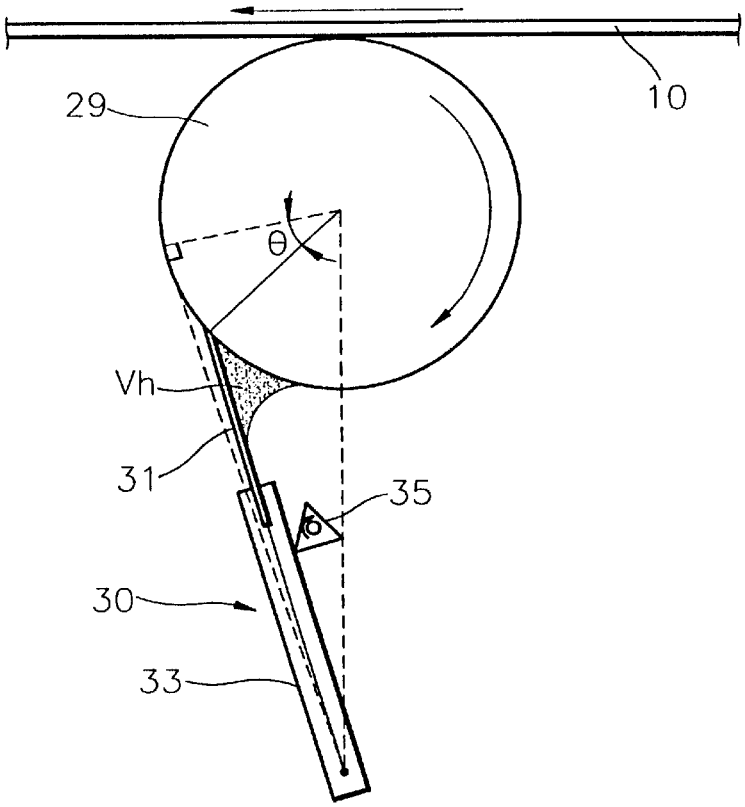
FIG. 2 (PRIOR ART)
FIG. 2 is a side view of the apparatus for cleaning a squeeze roller for a conventional liquid printer.
Figure 8:
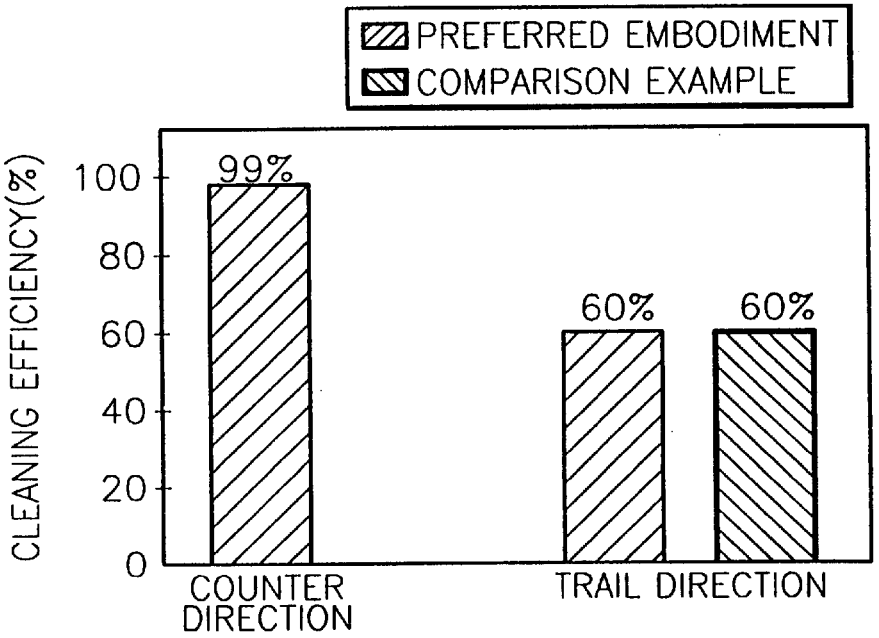
FIG. 8 is a graph indicating the comparison results of the cleaning efficiency between the preferred embodiment and the comparison examples.

FIG. 8 is a graph indicating the comparison results of the cleaning efficiency between the apparatus for cleaning a squeeze roller having the above structure according to a preferred embodiment of the present invention and the conventional cleaning apparatus described with reference to FIGS. 2 and 3. As indicated in the graph, when cleaning is performed by disposing the squeeze roller 29 in a trailing direction using the apparatus for cleaning a squeeze roller 40 according to the present invention, the cleaning efficiency is about 60% that of in the comparison examples. However, when the squeeze roller 29 disposed in the trail counter direction and the cleaning is performed, the cleaning efficiency is about 99%.

As described above, in the apparatus for cleaning a squeeze roller having the structure according to the present invention, since the blade is formed using the rigid plate and a cover member is made of a material such as TEFLON covering the plate, the durability of the blade is improved so as to be used semi-permanently, i.e., printing up to about 100,000 sheets of paper. Also, abrasion of the squeeze roller by the plate can be prevented so that the quality of image can be improved.

Further, the overturn of the blade generated due to the material properties of the cover member is fundamentally solved so that the blade can be disposed in the trail counter direction. Thus, holding volume is not generated and the generation of foreign material is restricted. Accordingly, the spanking mechanism for removing the holding volume is essentially not needed.

What is claimed is:

1. An apparatus for cleaning a squeeze roller of a liquid printer by which developer adhering to an outer circumferential surface of said squeeze roller is removed, said apparatus comprising:

a blade holder; and a blade which comprises a plate having a predetermined rigidity and a cover member having a weaker rigidity than said plate, said cover member being coated on or adhering to an outer surface of said plate, one end of said blade being fixedly coupled to said blade holder and an opposite end of said blade contacting the outer circumferential surface of said squeeze roller, wherein said blade is disposed to be slanted in a trail counter direction with respect to a rotational direction of said squeeze roller in a drip-line removing mode so that the developer adhering to said squeeze roller is removed, wherein said blade is disposed to be bent as said blade contacts said squeeze roller creating a blade interference such that pressure applied to the outer circumferential surface of said squeeze roller increases due to an elastic bias, and wherein said blade interference is defined by an amount of R−r which satisfies the condition:

$$0.5\ \text{mm} < R - r < 2.5\ \text{mm},$$

wherein R is a radius of said squeeze roller and r is a distance between the center of said squeeze roller and a leading edge of said blade when the elastic bias of said blade to said squeeze roller has been removed.

2. An apparatus for cleaning a squeeze roller of a liquid printer by which developer adhering to an outer circumferential surface of said squeeze roller is removed, said apparatus comprising:

a blade holder; and a blade which comprises a plate having a predetermined rigidity and a cover member having a weaker rigidity than said plate, said cover member being coated on or adhering to an outer surface of said plate, one end of said blade being fixedly coupled to said blade holder and an opposite end of said blade contacting the outer circumferential surface of said squeeze roller, wherein said blade is disposed to be slanted in a trail counter direction with respect to a rotational direction of said squeeze roller in a drip-line removing mode so that the developer adhering to said squeeze roller is removed, wherein the blade has a length a of tension and a length b of a fixed blade which satisfy the conditions:

$$8\ \text{mm} < a < 15\ \text{mm};$$

and $$2.0\ \text{mm} < b,$$

wherein a is the length from a leading edge of said blade holder to a leading edge of said blade and b is the length of said blade which is fixedly inserted in said blade holder.

3. An apparatus for cleaning a squeeze roller of a liquid printer by which developer adhering to an outer circumferential surface of said squeeze roller is removed, said apparatus comprising:

a blade holder; and a blade which comprises a plate having a predetermined rigidity and a cover member having a weaker rigidity than said plate, said cover member being coated on or adhering to an outer surface of said plate, one end of said blade being fixedly coupled to said blade holder and an opposite end of said blade contacting the outer circumferential surface of said squeeze roller, wherein said blade is disposed to be slanted in a trail counter direction with respect to a rotational direction of said squeeze roller in a drip-line removing mode so that the developer adhering to said squeeze roller is removed, wherein a blade pressure angle θ between line segments $\overline{CP_2}$ and $\overline{CT}$ satisfies the condition:

$$5^\circ < \theta < 30^\circ,$$

wherein C is the center of said squeeze roller; P1 is a point where a line segment concurrently passing C and perpendicular to a proceeding direction of said photosensitive medium meets with a center in a widthwise direction of said blade holder; P2 is a point of contact between a leading edge of said blade and the outer circumferential surface of said squeeze roller; T is a tangent point closer to P2 among two tangent points made by definite straight lines passing through P1 and contacting the outer circumference of said squeeze roller.

* * * * *